United States Patent [19]

McDowell

[11] 4,053,962

[45] Oct. 18, 1977

[54] SUCTION-CLEANING DUST RETRIEVER

[76] Inventor: Robert V. McDowell, 160 Melrose Drive, Danville, Va. 24541

[21] Appl. No.: 641,282

[22] Filed: Dec. 16, 1975

[51] Int. Cl.[2] ..... A47L 9/02

[52] U.S. Cl. ..... 15/415 R

[58] Field of Search ..... 15/396, 397, 400, 395, 15/414, 415, 416, 420, 393, 418, 417, 419, 421, 401, 402; 285/7, 177

[56] References Cited

U.S. PATENT DOCUMENTS

| | | | |
|---|---|---|---|
| 986,245 | 3/1911 | Thurman | 15/415 |
| 1,752,664 | 4/1930 | Forcier | 15/419 X |
| 2,659,924 | 11/1953 | Forsberg | 15/400 X |
| 2,665,446 | 1/1954 | Gregory | 15/396 |
| 2,679,068 | 5/1954 | Wied | 15/400 X |
| 2,913,756 | 11/1959 | MacFarland | 15/400 X |

FOREIGN PATENT DOCUMENTS

| | | | |
|---|---|---|---|
| 104,536 | 5/1942 | Sweden | 15/395 |
| 291,760 | 11/1928 | United Kingdom | 15/396 |

*Primary Examiner*—Christopher K. Moore
*Attorney, Agent, or Firm*—Griffin, Branigan and Butler

[57] ABSTRACT

A vacuum-cleaner nozzle attachment comprises an elongated tube having an oblong cross-sectional shape over an outer, working section thereof and a round cross-sectional shape over an inner section. At an outer working tip thereof an opening defines an angle of more than 20° but not more than 60° with an axis of elongation of the tube. An attaching portion at an opposite end of the elongated tube has a wall which forms tapered, stepped cavities which can be force fitted onto various size vacuum-cleaner nozzles. The two sections can be forced fitted together. In one embodiment, the angled opening does not extend over the entire cross-sectional area of the tube, but rather only over a portion thereof and the remaining portion has an opening formed therein which is perpendicular to the axis of elongation. In another embodiment, the remaining portion is covered rather than being open. In a further embodiment of the invention an elbow attachment can be force fitted to the outer working tip of the elongated tube. An attaching portion of the elbow has an oblong cross-sectional shape to mate with the oblong section of the tube, and a working portion thereof has a rectangular shape.

8 Claims, 9 Drawing Figures

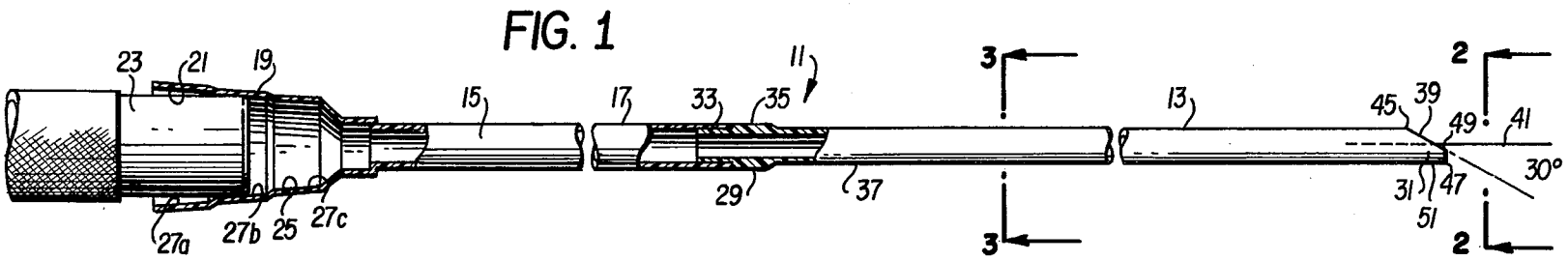
FIG. 1
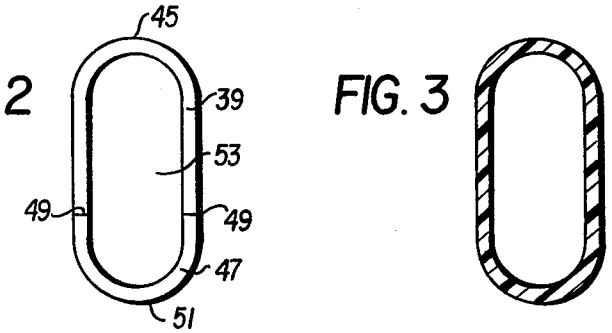
FIG. 2
FIG. 3
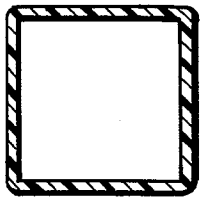
FIG. 5
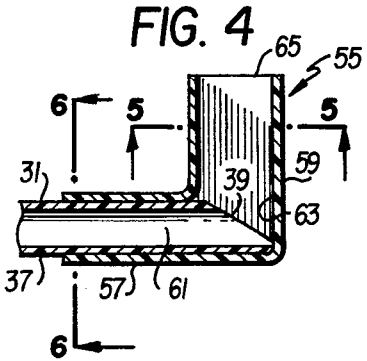
FIG. 4
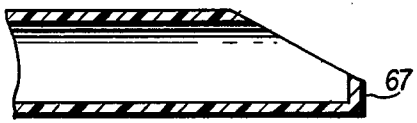
FIG. 8
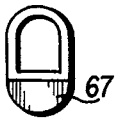
FIG. 9
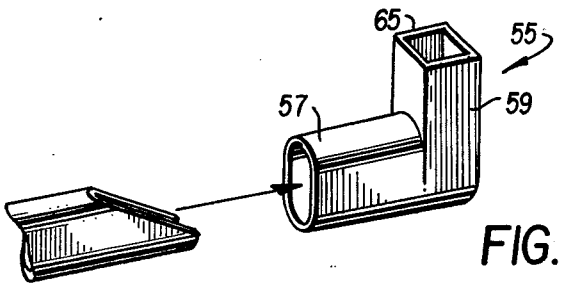
FIG. 7
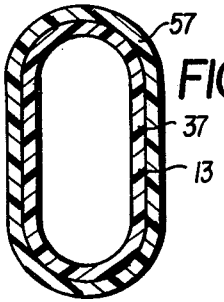
FIG. 6

SUCTION-CLEANING DUST RETRIEVER

BACKGROUND OF THE INVENTION

This invention relates broadly to the art of vacuum cleaners, and more particularly to specialized attachments therefor for cleaning in difficult-access locations.

Some patents which describe specialized vacuum-cleaner nozzle attachments include U.S. Pat. Nos.: 986,245 to Thurman; 1,404,889 to Owen; 1,651,894 to Kent et al.; 2,448,693 to Trelease et al.; 2,581,002 to Creswell; 2,715,240 to Pieper et al.; 2,740,153 to Bishop; and 3,751,755 to Smith.

Thurman disclosed a vacuum nozzle comprising a flattened tube having rectangular openings on the sides thereof for cleaning the tops of books, under desks, and the like. An opening O' is formed in a small edge of the tube so that the tool may be inserted in a narrow way between two books to reach the tops of shorter and thinner books.

A difficulty with the tool of Thurman is that it only provides suction in a lateral, or side, direction which is not desireable for cleaning refrigeration coils on refrigerators and air conditioning units. It is desireable to simultaneously provide suction laterally as well as forwardly at the end of a tool. Thus, it is an object of this invention to provide a vacuum cleaner nozzle attachment or tool which simultaneously provides lateral as well as end-wise suction.

Although some vacuum-cleaner tools have openings cut on an angle at the tips thereof, these angles are not properly designed relative to the shapes of the tools to allow meaningful lateral suction in addition to end-wise tip suction. Thus, it is an object of this invention to provide a vacuum-cleaning tool the end of which is cut on an appropriate angle for producing both a meaningful lateral suction as well as end-wise tip suction.

Because there are numerous makes and models of vacuum cleaners having various size nozzles, it is often necessary to buy a particular nozzle attachment or tool that is specially made for a particular vacuum cleaner. Thus, it is an object of this invention to provide a vacuum-cleaner tool which can be fitted onto a variety of vacuum-cleaner nozzle sizes.

It is a further object of this invention to provide a vacuum-cleaner tool which can reach relatively deep, inaccessible areas but which can be stored in a relatively small area.

It is a further object of this invention to provide an attachment for reaching "deep" inaccessible areas but which is highly flexible in application in that it can provide adequate suction for cleaning a surface which must be approached laterally to the tool.

SUMMARY

According to principles of this invention, a vacuum-cleaner tool or attachment comprises an elongated tube having an oblong cross-sectional shape over an outer working section thereof. An outer working tip of the tube is cut on an angle to the axis of elongation of more than 20° but less than 60°. This angled cut extends over only a portin of the cross-sectional circumference of the tube, with the remainder of the circumference being open and oriented perpendicular to the axis of elongation. In another embodiment, the remainder is covered. The tube is formed of two sections which can be force fitted together. The first section has a round cross-section and the second section —the outer working section— has the oblong cross-section.

An elbow attachment is mountable on the working tip of the tube for reaching areas which can only be approached laterally to the tube. The elbow has a rectangular cleaning opening and an oblong mounting opening.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 1 is a partially cutaway side view of a vacuum cleaner nozzle attachment employing principles of this invention mounted on a vacuum-cleaner nozzle;

FIG. 2 is an end view of the attachment of FIG. 1 taken from line 2—2 in FIG. 1;

FIG. 3 is a cross-sectional view taken on line 3—3 in FIG. 1;

FIG. 4 is a cross-sectional view of an elbow attachment employing principles of this invention mounted on the outer end, or tip, of the attachment of FIG. 1;

FIG. 5 is a sectional view taken on line 5—5 in FIG. 4;

FIG. 6 is a sectional view taken on line 6—6 in FIG. 4;

FIG. 7 is an isometric, exploded, view of the elbow attachment system of FIG. 4;

FIG. 8 is a side sectional view of another embodiment of the working tip of the attachment of FIG. 1; and, FIG. 9 is an end view of the working tip of FIG. 8.

DESCRIPTION OF THE PREFERRED EMBODIMENT

With reference to FIG. 1 a vacuum cleaner nozzle attachment 11 comprises an outer working section 13 and an inner attaching section 15. Preferrably, both sections are made of polystyrene. The nozzle attachment 11 is approximately 24 inches long including both sections.

The attaching section 15 includes a smaller tubular portion 17 having a circular cross-section and a larger attaching portion 19. The smaller tubular portion 17 has an internal diameter of ½ inch. The larger, attaching portion 19 defines a cavity 21 for receiving a nozzle 23 of a vacuum cleaner. The wall of the attaching portion 19 is shaped to form a tapered, stepped inner surface 25. Steps 27*a, b,* and *c* are themselves tapered inwardly toward the tubular portion 17 so that they can be forced fitted onto various size nozzles 23. The internal diameters of these steps are designed to fit nozzles having 1¼ and 1½ inch external diameters, among others.

The outer working section 13 of the vacuum-cleaner nozzle attachment 11 has a mounting end 29 and a working tip 31. The mounting end 29 includes a round mounting tube 33 whose outer diameter is slightly larger than the inner diameter of the tubular portion 17 of the attaching section 15. Thus, the mounting tube 33 can be force fitted into the end of the section 15. An enlarged abutting portion 35 formed on the outer surface of the working section 13 abuts against the end tip of the attaching section 15 when the mounting tube 33 is mounted therein. The mounting tube 33 is circular in cross-sectional shape so as to fit into the tubular portion 17 of the attaching section 15; however, the remaining tubular portion 37 of the working section 13 is oblong in cross-section as is clearly depicted in FIG. 3. In this regard, the top and bottom walls thereof have internal diameters of ¼ inch, while the side walls are 3/16 of an inch long, thus providing an oblong shape. This oblong shape makes the working section 13 narrow for entering narrow areas.

The working tip 31 of the working section 13 is cut on an angle to form a opening therein having an outer periphery 39 forming a 30° angle with an axis of elongation 41. The plane formed by this periphery is approximately perpendicular to the sidewalls of the working section 13. The outer periphery 39 extends from the top 45 of the tubular portion 37 to an outer tip 47 to form intersections 49 (FIG. 2) with the outer tip 47 intermediate the top 45 and a bottom 51. The outer tip 47 lies on a plane perpendicular to the axis of elongation 41 of the working section 13. In the embodiment of FIGS. 1–3, the outer tip is open. Hence, the periphery of an opening 53 into the working tip 31 extends (from the bottom to the top) first in a plane perpendicular to the axis of elongation, and then in a plane forming a 30° angle with the axis of elongation.

It will be understood by those skilled in the art that the opening 53 in the working tip 31 provides suction both endwise and laterally, or sidewise, of the working section 13. In this respect, although it has been found that a 30° angle produces the most proficient lateral suction, creditable results can also be obtained with an angle as small as 20° and as great as 60°. The perpendicular outer tip 47 allows the working section 13 to more easily "pick up" materials lying on a surface that is perpendicular to the direction in which the vacuum-cleaner nozzle attachment 11 extends.

The tapered, stepped attaching portion 19 gives the vacuum-cleaner nozzle attachment 11 a more universal application in that it can be fitted on various types of vacuum cleaner nozzles. Further, by providing a knock-down construction of the vacuum-cleaner nozzle attachment 11 it can be stored in a smaller area than would otherwise be possible.

An adapter 55 which is mountable onto the vacuum-cleaner nozzle attachment 11 is depicted in FIGS. 4–7. The adapter 55 allows the vacuum-cleaner nozzle attachment 11 to be used to clean walls which are parallel to the axis of elongation of the vacuum-cleaner nozzle attachment 11 but must be approached from a direction laterally of the attachment. In this respect, the adapter 55 has an oblong mounting portion 57 which can be force fitted onto the working tip 31 of the working section 13. A cleaning portion 59 of the adapter 55 has a rectangular shape as can be seen in FIGS. 5 and 7. Since the angled outer periphery 39 of the working tip 31 is cut on an angle, a bore 61 of the tubular portion 37 communicates with a cavity 63 formed in the cleaning portion 59, as is more clearly depicted in FIG. 4. Thus, suction is provided at a working tip 65 of the adapter 55. The cleaning portion 59 is ¼ inch square in cross section.

FIG. 8 depicts another embodiment similar to the FIGS. 1–3 embodiment wherein an outer tip 67, corresponding to the outer tip 47 in FIG. 1, is covered rather than being open. In this embodiment, more suction is provided in a lateral direction than in the FIG. 1 embodiment.

In operation of the various embodiments of the invention, the vacuum-cleaner nozzle attachment 11 is normally stored disassembled with the working section 13 pulled out of the attaching section 15. When it is desired to use the vacuum-cleaner nozzle attachment 11, the sections 13 and 15 are assembled by pressing them together as depicted in FIG. 1, and the attachment 11 is mounted on the vacuum-cleaner nozzle 23 by pressing the nozzle 23 into the cavity 21 of the attaching portion 19. The working tip 31 is then inserted into small areas, such as between the cooling coils of a refrigerator, and dust is sucked both from the front and the side of the working tip 31. When the FIGS. 8 and 9 embodiment is employed a greater suction is provided to the side than in the FIGS. 1–3 embodiment. When it is desired to vacuum a lateral wall of a narrow space, the elbow adapter 55 is forced onto the working tip 31 of the vacuum-cleaner nozzle attachment 11 as is depicted in FIGS. 4 and 7. The rectangular working tip 65 of the elbow adapter 55 is then moved toward the lateral wall to be cleaned.

It will be understood by those skilled in the art that the relative dimensions and shapes of the various parts in the vacuum-cleaner nozzle attachment of this invention make it highly useful for cleaning dust from narrow areas.

While the invention has been particularly shown and described with reference to preferred embodiments, it will be understood by those skilled in the art that various changes in form and detail may be made therein without departing from the spirit and scope of the invention.

The embodiments of the invention in which an exclusive property or privilege are claimed are defined as follows:

1. A vacuum-cleaner hose attachment comprising:

an attaching portion having walls for defining an open cavity having a circular cross-sectional shape, said open cavity being of a size for receiving a hose member from a vacuum cleaner, said walls forming a tapered, stepped cavity for force fitting onto hose members of various sizes from vacuum cleaners; and an elongated tube rigidly connected to said attaching portion with a bore thereof communicating with said attaching-portion cavity, said elongated tube including a working-end portion, said working-end portion having an oblong cross-sectional shape taken in a plane perpendicular to its axis of elongation such that it includes long sidewalls and shorter endwalls, said working-end portion's outer tip defining an opening therein the periphery of which defines a plane having an angle of more than 20°, but not more than 60° with the axis of elongation and extending approximately perpendicular to said long sidewalls.

2. A vacuum-cleaner hose attachment as in claim 1 wherein said elongated tube is formed of two detachable sections which may be force fitted together.

3. A vacuum-cleaner hose attachment as in claim 2 wherein a first section of said elongated tube has a round cross-sectional shape and wherein said second section has said oblong cross-sectional shape over most of the length thereof, but which has a circular cross-sectional shape for mating with the circular cross-sectional shape of said first section.

4. A vacuum-cleaner hose attachment as in claim 1 wherein the periphery of said opening forms approximately a 30° angle with said axis of elongation.

5. A vacuum-cleaner hose attachment as in claim 1 wherein said periphery of said opening having an angle does not extend over the entire cross section of said working-end portion.

6. A vacuum-cleaner hose attachment as in claim 5 wherein another portion of said working-end portion's outer tip defines a plane perpendicular to the axis of elongation.

7. A vacuum-cleaner hose attachment as in claim 5 wherein said another portion is covered.

8. A vacuum-cleaner hose attachment comprising:

an attaching portion having walls for defining an open cavity having a circular cross-sectional shape, said open cavity being of a size for receiving a hose member from a vacuum cleaner, said attaching portion including an attaching means for holding said hose member in said cavity; and an elongated tube rigidly connected to said attaching portion with a bore thereof communicating with said attaching-portion cavity, said elongated tube including a working-end portion, said working-end portion having an oblong cross-sectional shape taken in a plane perpendicular to its axis of elongation such that it includes long sidewalls and shorter endwalls, said working-end portion's outer tip having an opening therein the periphery of which defines a plane having an angle of more than 20°, but not more than 60° with the axis of elongation and extending approximately perpendicular to said long sidewalls, and another portion which defines a plane perpendicular to the plane of elongation, said another portion of said outer tip being covered.

* * * * *